US007771077B2

(12) United States Patent
Miller

(10) Patent No.: US 7,771,077 B2
(45) Date of Patent: Aug. 10, 2010

(54) MECHANISM AND CAP FOR AN ELECTRICALLY POWERED DEVICE, ELECTRICALLY POWERED DEVICE AND LIGHTING DEVICE WITH SUCH A CAP

(76) Inventor: Rodney H. Miller, 78 Summit Crescent, Westmount, Quebec (CA)

( * ) Notice: Subject to any disclaimer, the term of this patent is extended or adjusted under 35 U.S.C. 154(b) by 51 days.

(21) Appl. No.: 11/416,326

(22) Filed: May 3, 2006

(65) Prior Publication Data

US 2007/0258236 A1 Nov. 8, 2007

(51) Int. Cl.
*F21L 4/04* (2006.01)
*H01R 24/00* (2006.01)

(52) U.S. Cl. ..... 362/206; 200/51.08; 439/332

(58) Field of Classification Search ..... 362/202, 362/205, 206, 208; 200/51.13, 277, 60, 332.2, 200/336, 51.08, 564; 42/146; 439/614, 318, 439/320, 332, 374
See application file for complete search history.

(56) References Cited

U.S. PATENT DOCUMENTS

| | | | | |
|---|---|---|---|---|
| 617,592 | A | 1/1899 | Misell | |
| 1,084,926 | A | 1/1914 | Burgess | |
| 1,144,201 | A | 6/1915 | Hipwell et al. | |
| 2,469,163 | A | 5/1949 | Gilmore | |
| 2,677,022 | A * | 4/1954 | Fleming | 200/60 |
| 4,489,297 | A | 12/1984 | Haydon et al. | |
| 4,680,683 | A | 7/1987 | Schenke et al. | |
| 5,008,785 | A | 4/1991 | Maglica et al. | |
| 5,160,201 | A * | 11/1992 | Wrobel | 362/249 |
| 5,855,426 | A | 1/1999 | Burns | |
| 6,225,580 | B1 * | 5/2001 | Lemire | 200/11 DA |
| 6,866,395 | B2 * | 3/2005 | Phipps et al. | 362/198 |
| 7,140,747 | B2 * | 11/2006 | Yang | 362/202 |
| 7,246,927 | B2 * | 7/2007 | Wikle et al. | 362/396 |
| 7,281,815 | B1 * | 10/2007 | Gustafson et al. | 362/206 |
| 7,311,417 | B1 * | 12/2007 | Lemke | 362/158 |
| 2001/0000685 | A1 | 5/2001 | Maglica | |
| 2002/0041494 | A1 | 4/2002 | Maglica | |
| 2005/0063180 | A1 | 3/2005 | Maglica | |
| 2005/0174772 | A1 | 8/2005 | Gun | |
| 2005/0281022 | A1 * | 12/2005 | Liaw et al. | 362/208 |

* cited by examiner

*Primary Examiner*—Stephen F Husar
*Assistant Examiner*—Peggy A. Neils

(57) ABSTRACT

The present subject matter relates to a tail cap for portable lighting device such as a flashlight. The tail cap includes a locking mechanism which secures the tail cap on the flashlight as well as enables or disables the switch that activates, or deactivates the flashlight and/or its various lighting modes. The tail cap with the present multi-purpose locking mechanism allows the user to rapidly replace the battery, and ensures that the switch and contact pins return to the correct position, after the tail cap is reinserted. The combined use of a magnetic switch and O-ring gasket between the tail cap and main housing ensures complete waterproofing. The ambidextrous switch consisting of either a switch bar or dual push-button switch located on the rear wall of the tail cap allows ambidextrous use, even when the flashlight is mounted on a firearm such as a handgun, where the trigger guard would normally interfere with the operation of a switch mounted on the rear face of the flashlight.

17 Claims, 15 Drawing Sheets

MECHANISM AND CAP FOR AN ELECTRICALLY POWERED DEVICE, ELECTRICALLY POWERED DEVICE AND LIGHTING DEVICE WITH SUCH A CAP

TECHNICAL FIELD

The subject matter presented herein relates to lighting devices. More specifically, the subject matter presented herein relates to portable lighting devices such as flashlights.

BACKGROUND

Lighting devices of varying sizes and shapes, including flashlights, are known in the lighting art. Conventionally, flashlights utilize one or more dry cell batteries, carried in series in a usually cylindrical tube serving as a handle for the flashlight, as their source of electrical energy. Flashlights which may have their batteries recharged with a constant current recharger are also known. Typically, an electrical circuit is established from one electrode of the battery through a conductor to a switch, then through a conductor to one electrode of the light source, e.g. lamp bulb. After passing through the filament of the lamp bulb, the electrical circuit emerges through a second electrode of the lamp bulb in electrical contact with a conductor, which in turn may be in electrical contact with the flashlight housing. The flashlight housing may be used as an electrical conduction path to an electrical conductor, generally a spring element, in contact with the other electrode of the battery. Alternatively, the electrical circuitry may be totally insulated from the flashlight housing. Actuation of a switch mechanism completes the electrical circuit enabling the electrical current to pass through the filament, thereby generating light which is typically focused by a reflector and lens assembly or by a collimator to form a beam of light.

Flashlights, in particular, which are used by personnel employed in law enforcement, fire and rescue, and the military, must be rugged, reliable, easily operational, and ideally waterproof due to emergency situations, occupational and environmental hazards, and adverse weather conditions that are frequently experienced by these individuals. Having a flashlight with a tail cap with a multi-purpose locking mechanism would be advantageous to such users.

It is advantageous to create a tail cap with a locking mechanism which would not only secure and seal the tail cap on the flashlight, but would also enable or disable the switch that activates, or deactivates the flashlight and/or its various lighting modes. In a disabled position, the flashlight would be prevented from being inadvertently turned on, which advantageously results inter alia in (a) saving of battery power, and (b) prevention of accidental disclosure of the position of the user, when, for example, the light is used as a tactical flashlight, for military or law enforcement purposes.

Additionally, it is advantageous to have a tail cap with a multi-purpose locking mechanism, which allows for a more rapid battery exchange, and ensures that the switch and contact pins return to the correct position, after the tail cap is reinserted. Insuring a proper positioning, together with a rapid battery exchange capability, create flashlight reliability desired for a lighting device in emergency and non-emergency situations.

Also, it is advantageous to locate the switch on the rear wall of the tail cap as it prevents inadvertent activation while holding the flashlight in the hand.

Further, by making the switch an ambidextrous switch, the flash light switch can be activated by either a right-handed or left-handed user, even when the flashlight is mounted on a firearm, such as a handgun, close to the trigger guard. Finally, it is advantageous to use a combination of a magnetic switch and an O-ring gasket, in order to make the flashlight waterproof.

SUMMARY

In accord with the present concepts disclosed herein, there is provided a tail cap for a portable lighting device. The tail cap includes a cap having an end wall with an outer surface. A substantially cylindrical side wall is included and extends from the end wall to the rim cylindrical side wall. A substantially circular plug is positioned within the cylindrical side wall and extends from an inner surface of the end wall to the rim of the cylindrical side wall. The substantially circular plug has an outer diameter smaller than an inner diameter of the substantially cylindrical side wall. A detent mechanism is located within the circular plug adjacent to an inner surface of the cylindrical side wall. It consists of a spring element positioned in a cavity of the circular plug in proximity to the cylindrical sidewall, parallel to the main axis of the flashlight. Such spring element extends beyond the front face of the circular plug, towards the main housing and mating notch on a lug of the main housing. A plurality of retractable electrical contact plugs is positioned along the outer diameter of the circular plug. The tail plug also features cavities that house the elements of a magnetic switch, being levers, pivots, sets of magnets, shield and a reed switch.

Also disclosed is a portable lighting device. The portable lighting device includes a head portion adapted to emit light produced by one or more light sources included within the head portion. An elongated substantially cylindrical housing is connected to and extends from the head portion to a rear end of the housing. The housing is adapted to receive at least one battery within an inner compartment of the housing located within the cylindrical housing, and accessed from the rear end of the cylindrical housing. A substantially cylindrical ring with a rim extends from the rear end of the cylindrical housing to the rim. The cylindrical ring has an outer diameter smaller than a diameter of the substantially cylindrical housing. A plurality of beveled lugs is positioned around the cylindrical ring, extending outwardly from said cylindrical ring and adapted to receive a tail cap portion.

Further disclosed is a portable lighting device including a head portion adapted to emit light from one or more light sources included within the head portion. An elongated substantially cylindrical housing is connected to and extends from the head portion to a rear end of the housing. A substantially cylindrical ring extends from the rear end of the cylindrical housing to the cylindrical ring's rim. The cylindrical ring has an outer diameter smaller than a diameter of the substantially cylindrical housing. A plurality of beveled lugs is positioned around the cylindrical ring and extending outwardly from the cylindrical ring. The portable lighting device includes a removable tail cap having an end wall including an outer surface; and a substantially cylindrical side wall extending from the end wall to the rim of the side wall. A substantially circular plug is positioned within the cylindrical side wall and extends from an inner surface of the end wall to the rim of the cylindrical side wall. The substantially circular plug has an outer diameter smaller than an inner diameter of the substantially cylindrical side wall. A ring extends around and is in contact with an inner surface of the cylindrical side wall, adjacent to the rim. This ring includes a plurality of slots at predetermined positions around the ring and is adapted to receive the plurality of beveled lugs.

Additional advantages and aspects of the present subject matter will become readily apparent to those skilled in the art from the following detailed description, wherein embodiments of the present subject matter are shown and described, simply by way of illustration of the best mode contemplated for practicing the present subject matter. As will be discussed below, the present subject matter is capable of other and different embodiments, and its several details are susceptible of modification in various obvious respects, all without departing from the spirit of the present subject matter. Accordingly, the drawings and description are to be regarded as illustrative in nature, and not limitative.

BRIEF DESCRIPTION OF THE DRAWINGS

The following detailed description of the embodiments of the present subject matter can best be understood when read in conjunction with the following drawings, in which the various features are not necessarily drawn to scale but rather are drawn as to best illustrate the pertinent features, and in which like reference numerals are employed throughout to designate similar features.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings.

Figure 1:
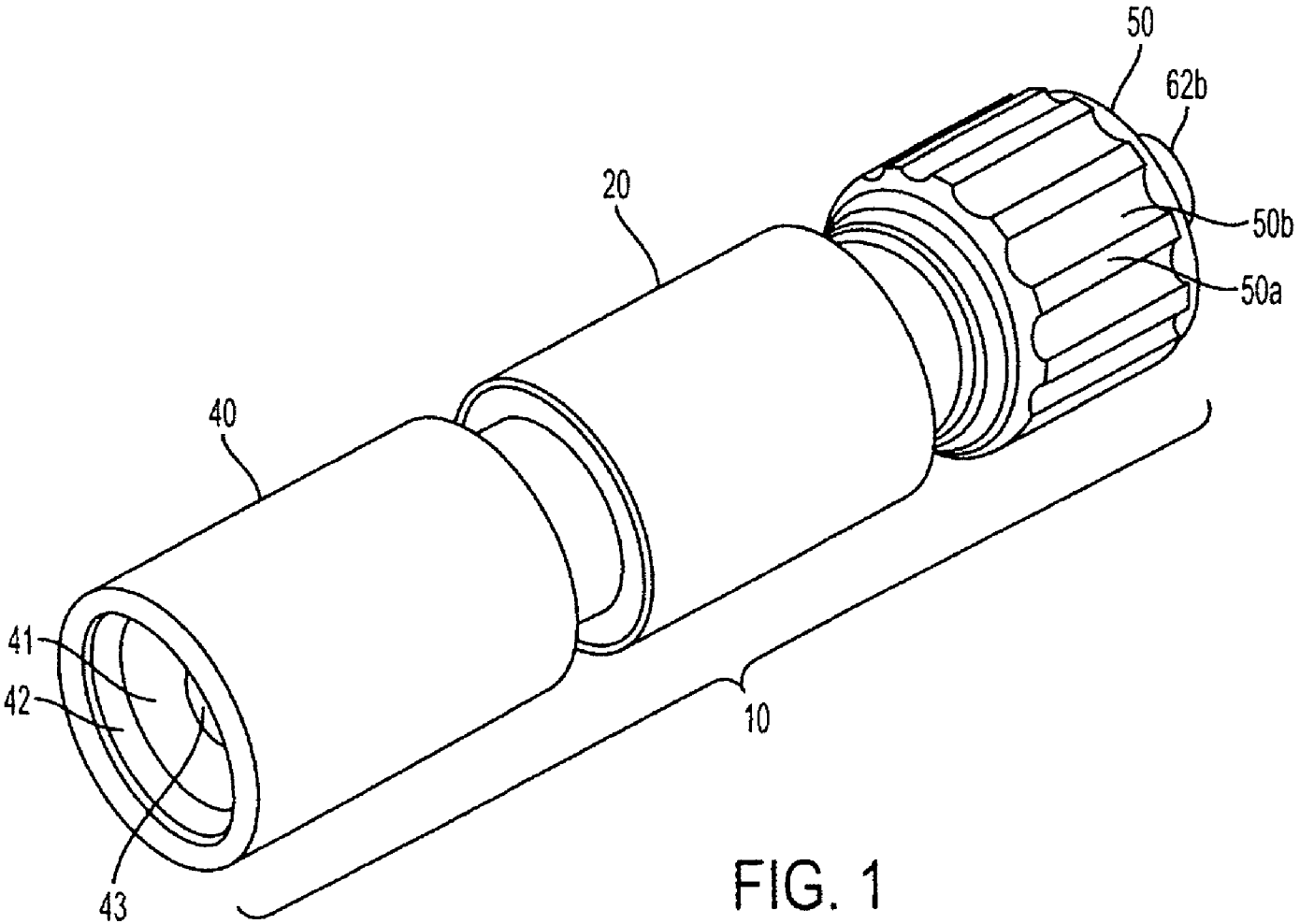
FIG. 1 depicts an exemplary side perspective view of the flashlight.

Adverting attention to the drawings, as shown in FIG. 1, the present flashlight 10 comprises a main body or housing 20, which may also serve as a gripping or handle portion with a tail cap 50, and a head portion 40. A variety of shapes and designs for the main housing 20 and head portion 40 are envisioned and not limited to the example shown in FIG. 1, so as not to unnecessarily obscure the key features of the present inventive concepts.

Figure 2:
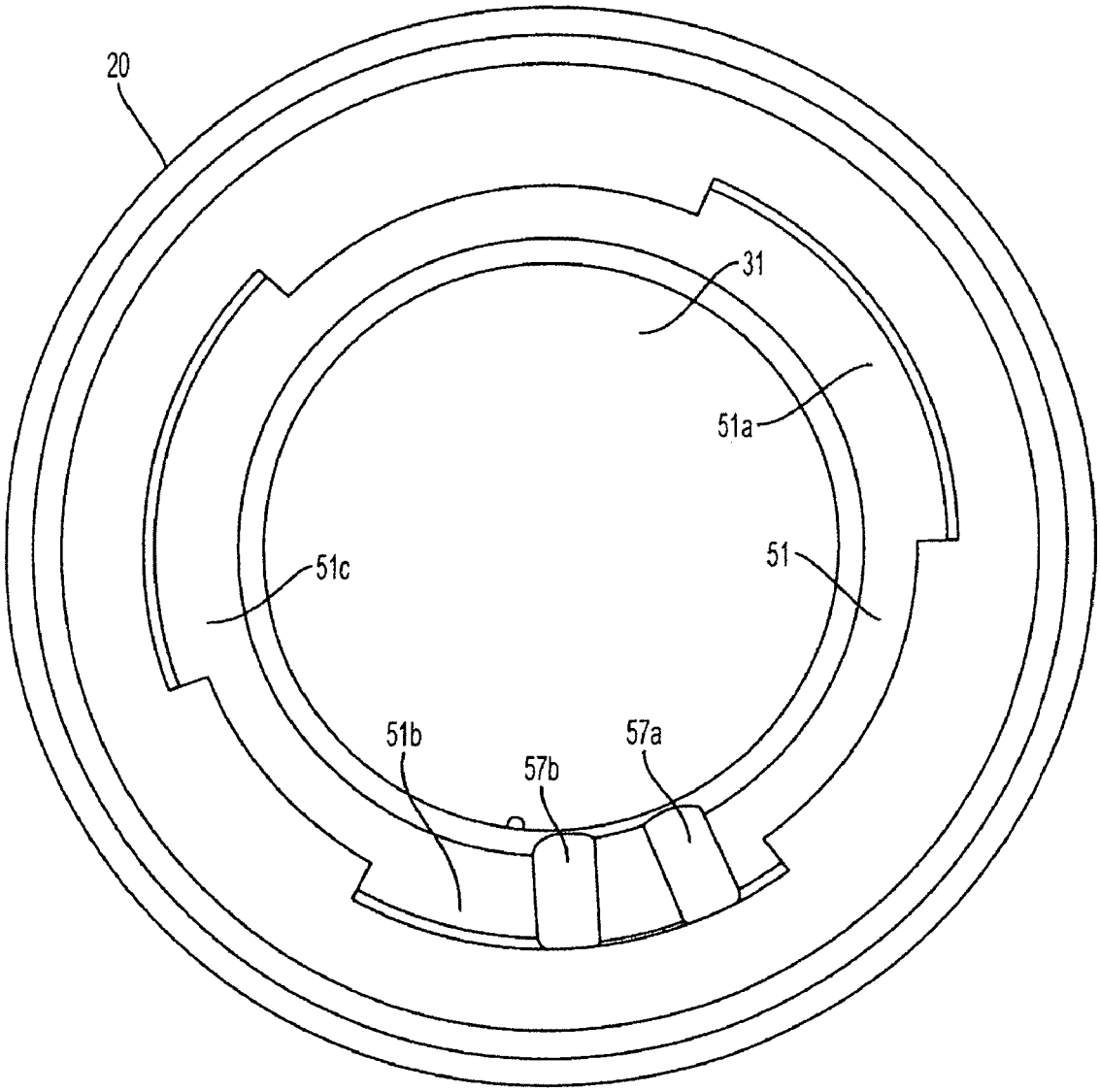
FIG. 2 is a back view of the main housing of the flashlight depicted in FIG. 1, without the tail cap.

The main housing or body 20 comprises an elongated substantially cylindrical compartment 31 (as shown in FIG. 2) for receiving a battery 70 (as shown in FIG. 19) or a plurality of batteries with contacts for supplying electrical power to the light sources housed in the head portion 40. In a preferred embodiment of the present invention, a thin sleeve of cylindrical shape 32 with an outer diameter smaller than an inner diameter of the main housing 20 is inserted inside of the main housing 20. A flexible printed circuit board 33 is inserted in a mating recess, on the outside wall of the cylindrical sleeve 32. The flexible printed circuit board may be held in place with glue or other adhesive means or may simply be wedged between the cylindrical sleeve 32 and the inside wall of the main housing 20. A tab 34 on the outside wall of the sleeve 32 matches a groove 35 on the inside wall of the main housing 20, to prevent rotation of the sleeve 32 inside of the housing 20, thus ensuring proper positioning of the contact plates 59 located on the flexible printed circuit board 33.

Figure 5:
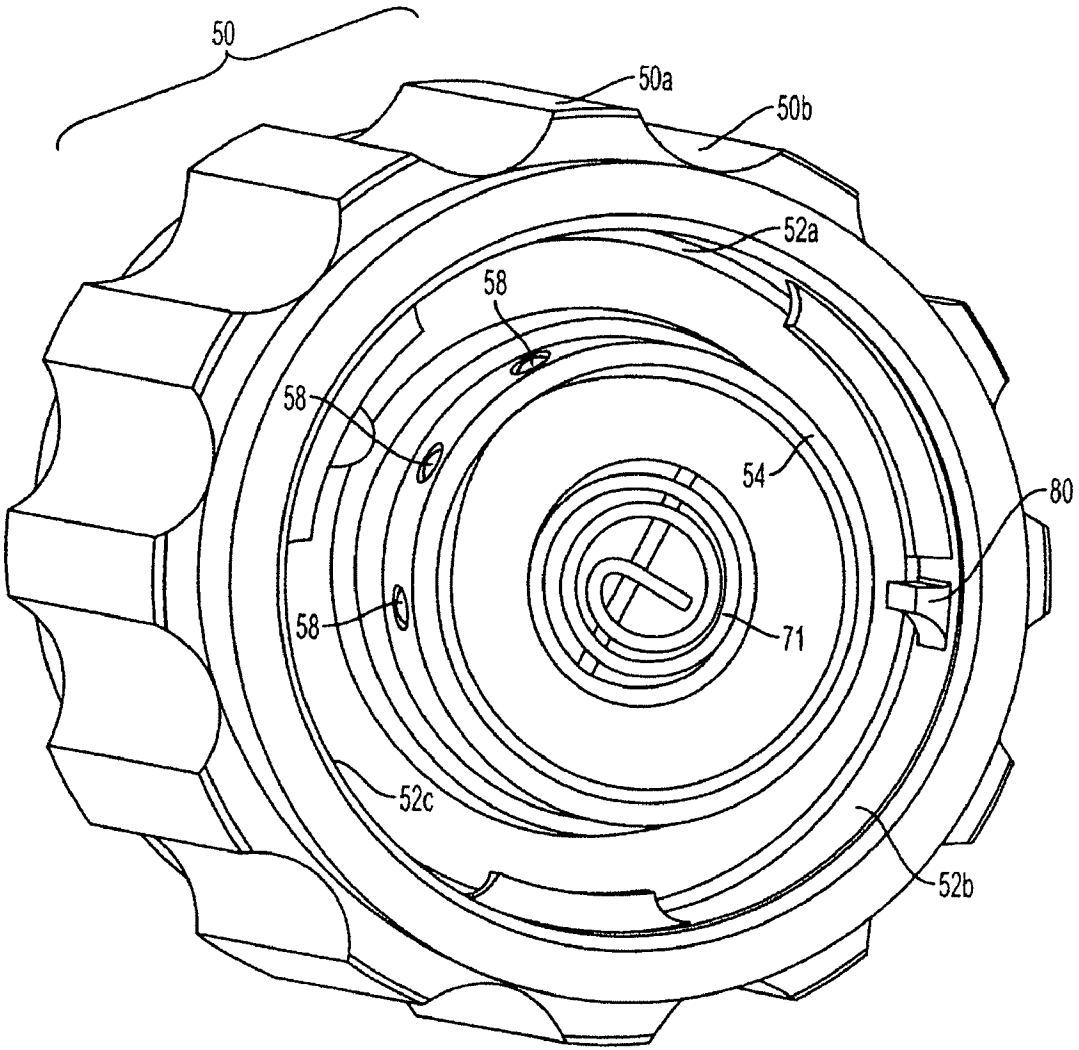
FIG. 5 is an inside perspective view of the tail cap of the flashlight of FIG. 1.

The light-emitting head portion 40 forms the luminescent head of the flashlight 10. The light-emitting head portion 40 comprises a transparent window 41 which is surrounded by a non-transparent collar 42. The transparent window 41 comprises a transparent glass or plastic lens, which is attached to the front end of the non-transparent collar 42 via a sealing ring (not shown) to prevent exposure to the outside environment and reduce the risk of water or other contaminants seeping into the light-emitting head 40 or main housing 20. The lens assembly may also be replaced by a solid collimator. Within the light-emitting head portion 40, one or more conventional light sources 43, a base support member for mounting the light source(s) (not shown) and optional reflective means (not shown) for main light reflecting light emitted from the light source(s) 43 and surrounded by its reflective surface(s) generally along a prescribed direction. The one or more light sources 43 can be a LED, a laser, an incandescent light source, lamp bulb, or other electrically driven light source. In this embodiment, the prescribed direction is towards the transparent window 41 (directional arrow A). Tail cap 50 includes one or more switches 62 for turning flashlight 10 off and on and/or for selecting lighting mode, i.e. low or high intensity, continuous, flashing, strobe, intermittent, etc. Another innovative aspect of this invention is the use of a switch bar 63, shown on FIGS. 13, 14 and 15, installed transversally on the outside face of the rear wall of the tail cap 50. As shown on FIGS. 14 and 15, the switch bar 63 is mechanically linked by a set of levers 64*b* to a set of magnets 64*g*, which are located inside a cavity of the tail plug 54. Said cavity 64*c*, wherein the plurality of magnets 64*a* and 64*g* is located, is closed off by a wall 64*d*. A reed switch 64*e*, located in a separate cavity on the opposite side of said wall 64*d*, is activated by the variations of the magnetic field resulting from the movements of the first set of magnets 64*a*. To cause said first set of magnets 64*a* to move, the operator depresses the switch bar. A rigid arm 63*a*, extending perpendicular to the switch bar 63 and through the rear wall of the tail cap 50, pushes either one of a set of two levers 64*b*, which levers 64*b* are held in place by and rotate around a pivot 64*h* point located at the end of the lever 64*b* that is closest to the perimeter of the tail plug 54. Pressure against the lever 64*b* causes the first set of magnets 64*a* to move towards the reed switch 64*e*. When the first set of magnets 64*a* comes within sufficient proximity of the reed switch 64*e*, the latter is triggered. When pressure upon the switch bar 63 is released by the operator, the second set of magnets 64*g* magnetically causes the first set of magnets 64*a* to return to its original position. The presence of the wall 64*d* between the cavity 64*c* containing the plurality of magnets 64*a* and 64*g* and the reed switch 64*e* and the "O" ring gasket 55 insulate the reed switch 64*e* and the other electrical components of the flashlight 10, from water or other contaminants by providing a waterproof seal. The switch bar 63 can be replaced by dual push-button switches or by a single push-button switch. The set of levers 64*b* can be replaced by a single lever when a single push button switch is used in lieu of the switch bar 63. Tail cap 50, as depicted in FIG. 5, comprises an outer rim with ridges 50*a* and valleys 50*b* to allow for improved gripping of the tail cap 50 by the user during removal from and addition to the main housing 20. In another embodiment, tail cap 50 comprises a substantially smooth outer rim with a rubber or rubber-like gripping aide fastened to the outer rim of the tail cap 50. The gripping aide can extend continuously around the outer rim of the tail cap and be smooth, embossed or grooved in texture.

Figure 3:
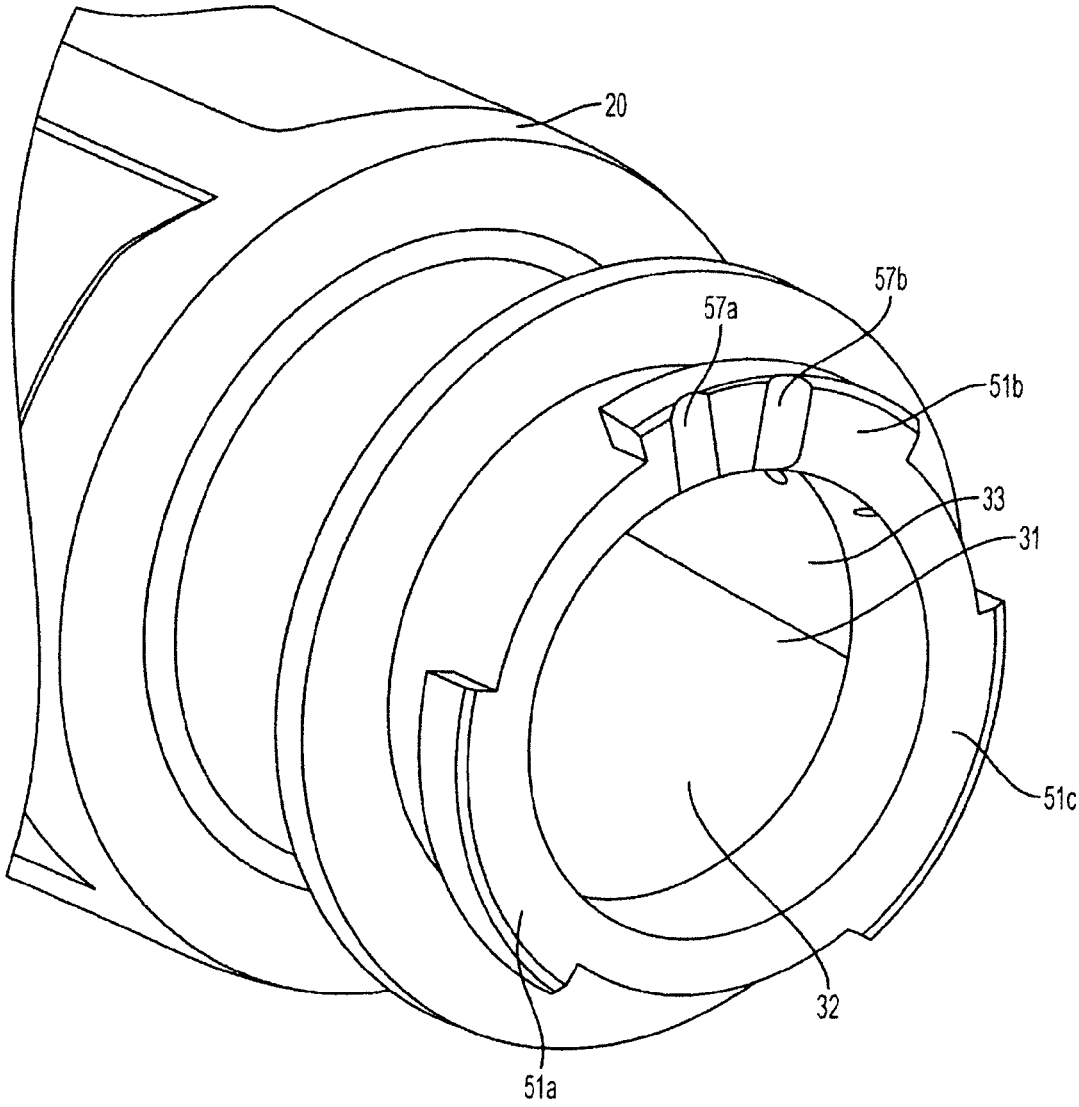
FIG. 3 depicts a perspective side view of the rear part of the main housing of the flashlight of FIG. 1.
Figure 4:
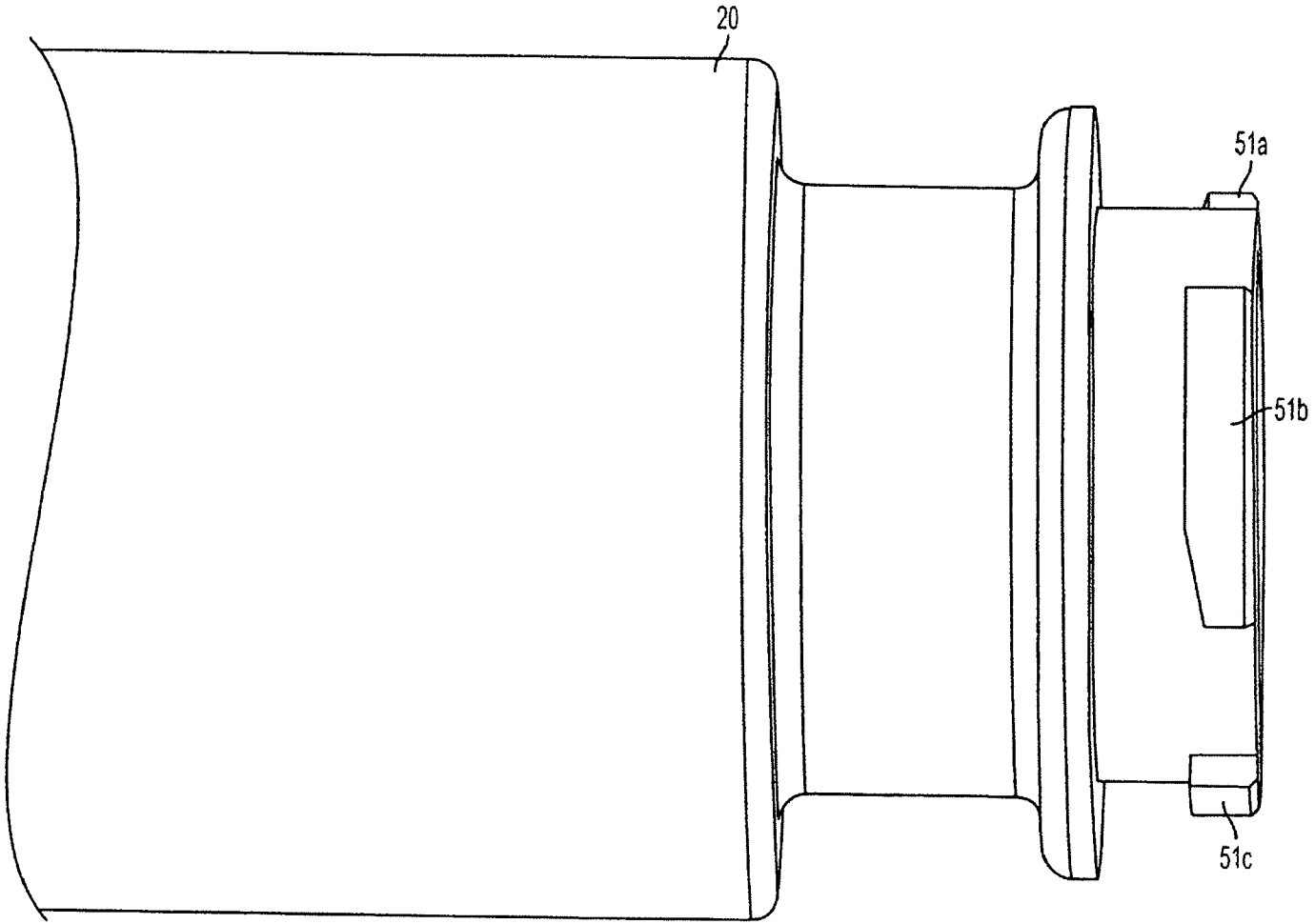
FIG. 4 depicts a side view of the rear part of the main housing of the flashlight of FIG. 1.

FIG. 2 is a rear view of main housing 20 of the flashlight 10 with tail cap 50 separated from main housing 20. Male portion 51 is formed as a circular or ring shape that extends outwardly from the rear of the main housing 20 and includes beveled lugs 51*a*, 51*b* and 51*c* positioned around the perimeter of male portion 51. When the tail cap 50 and the main housing 20 are properly aligned, beveled lugs 51*a*, 51*b* and 51*c* will engage with counterpart female slots formed in tail cap 50. Also illustrated in FIG. 2, is cylindrical compartment 31 for receiving battery 70 (shown in FIG. 18). FIG. 3 is another perspective side view of the main housing 20 of the flashlight 10 illustrated in FIG. 2. FIG. 3 also illustrates the flexible printed circuit board 33 secured to the interior wall of the cylindrical compartment 31. FIG. 4 is a side view of the rear part of the main housing 20 of flashlight 10 illustrated in FIG. 3. Male portion 51 has a smaller diameter than the overall circumference of the main housing 20 to accommodate tail cap 50.

Looking more specifically at the tail cap 50, reference is made to FIG. 5, which depicts an inside view of tail cap 50. Tail cap 50 includes a spring element 71 that is designed to come into contact with an electrode of the battery 70 positioned within the cylindrical compartment 31 when tail cap 50 is assembled together with main housing 20. Spring element 71 is positioned on a cylindrical tail plug 54 that extends outwardly from the center of tail cap 50. A concentric "O" ring gasket 55 is also present in the tail cap 50. When the tail cap 50 and the main housing 20 are engaged, the concentric "O" ring gasket 55 acts as a seal to prevent water and other contaminants from reaching the cylindrical compartment 31 containing the electrical circuitry (i.e. flexible circuit board 33) and the one or more batteries 70 present within the cylindrical compartment 31.

FIG. 5 also depicts the tail plug 54 extending outwardly from tail cap 50 with concentric "O" ring gasket 55 positioned therebetween. The pin 80 that extends outwardly from the rear wall of the main housing 20 is meant to act as a hard stop to prevent over rotation of the tail cap 50.

Tail cap 50 is mounted on the main housing 20 by way of a bayonet mount that includes a male portion (the bayonet) and a female portion (the bayonet ring). When the tail cap 50 and the main housing 20 are properly aligned, the beveled lugs 51*a*, 51*b* and 51*c* of the male portion 51, which together form the male part of the bayonet mount, engage with the slots 52*a*, 52*b* and 52*c* located on bayonet ring 52 of tail cap 50. In this embodiment, lug slots 52*a*, 52*b* and 52*c* located on bayonet ring 52 together constitute the female part of the bayonet mount. After engagement, when the tail cap 50 is rotated relative to the main housing 20, the beveled lugs 51*a*, 51*b* and 51*c* of the bayonet mount cause the tail cap 50 to become wedged against the main housing 20, and vice versa. The direction of rotation can be clockwise to install the tail cap 50, and counter clockwise to remove the sane. Alternatively, the direction of rotation can be counter clockwise to install the tail cap 50, and clockwise to remove the same.

Looking more specifically at the interaction of the tail cap 50 with the main housing 20 of flashlight 10 during rotation of the tail cap 50, reference is now made to FIGS. 6 through 9.

Figure 6:
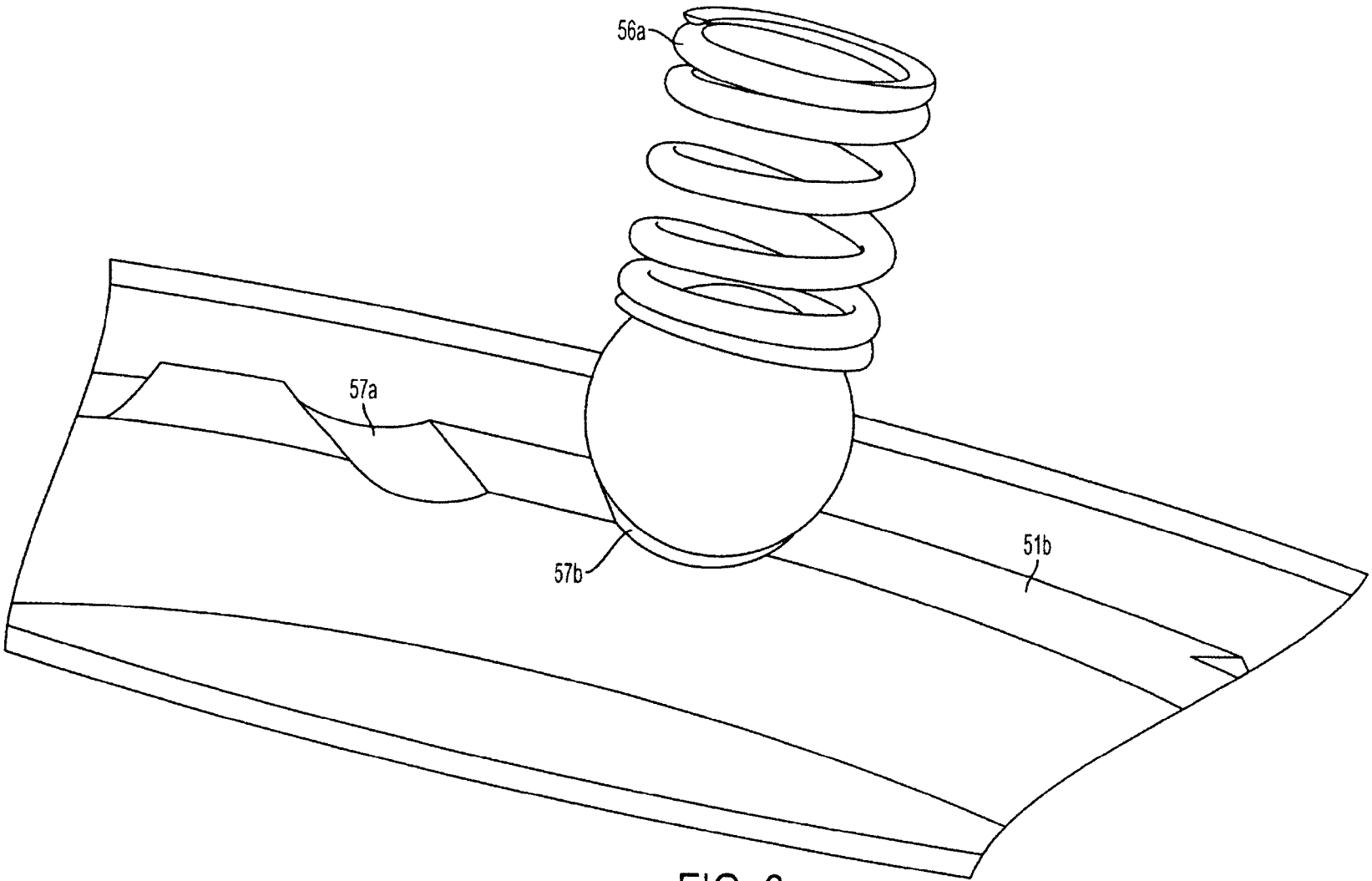
FIG. 6 depicts a close-up perspective view of a bayonet lug, located at the rear of the main housing of the flashlight, featuring the detent mechanism.

Adverting attention to FIG. 6, after a predetermined amount of rotation by the user of the tail cap 50 around the axis of the flashlight 10, a detent mechanism 56, securely fixed in the tail cap 50, includes a flat spring or spring-loaded ball bearing 56*a*, that engages in one of two grooves 57*a*, 57*b* located on beveled lug 51*a* of the male portion 51. In other embodiments, the grooves 57*a*, 57*b* can be positioned on beveled lug 51*b* or 51*c* rather than 51*a*, so long as both grooves are formed in the same beveled lug.

The rotational resistance caused by the flat spring or spring-loaded ball bearing 56*a*, when the ball bearing 56*a* or flat spring is engaged in groove 57*a*, is sufficient to secure the tail cap 50 on the main housing 20 of flashlight 10, and to provide tactile and/or audible feedback to the user that the tail cap 50 is properly engaged. In the first grooved position 57*a*, the flashlight switch 62 is disabled, in the off position. Continued rotation of the tail cap 50 causes the detent mechanism consisting of a flat spring or spring-loaded ball bearing 56*a* to move out of the first groove (disabled switch position) 57*a* and into a second groove (enabled switch position) 57*b*, as illustrated in FIG. 6. A hard stop, including a pin 80 or the like located in the tail cap plug 54, inside the tail cap 50, prevents over rotation of the tail cap 50, and disengagement.

Figure 7:
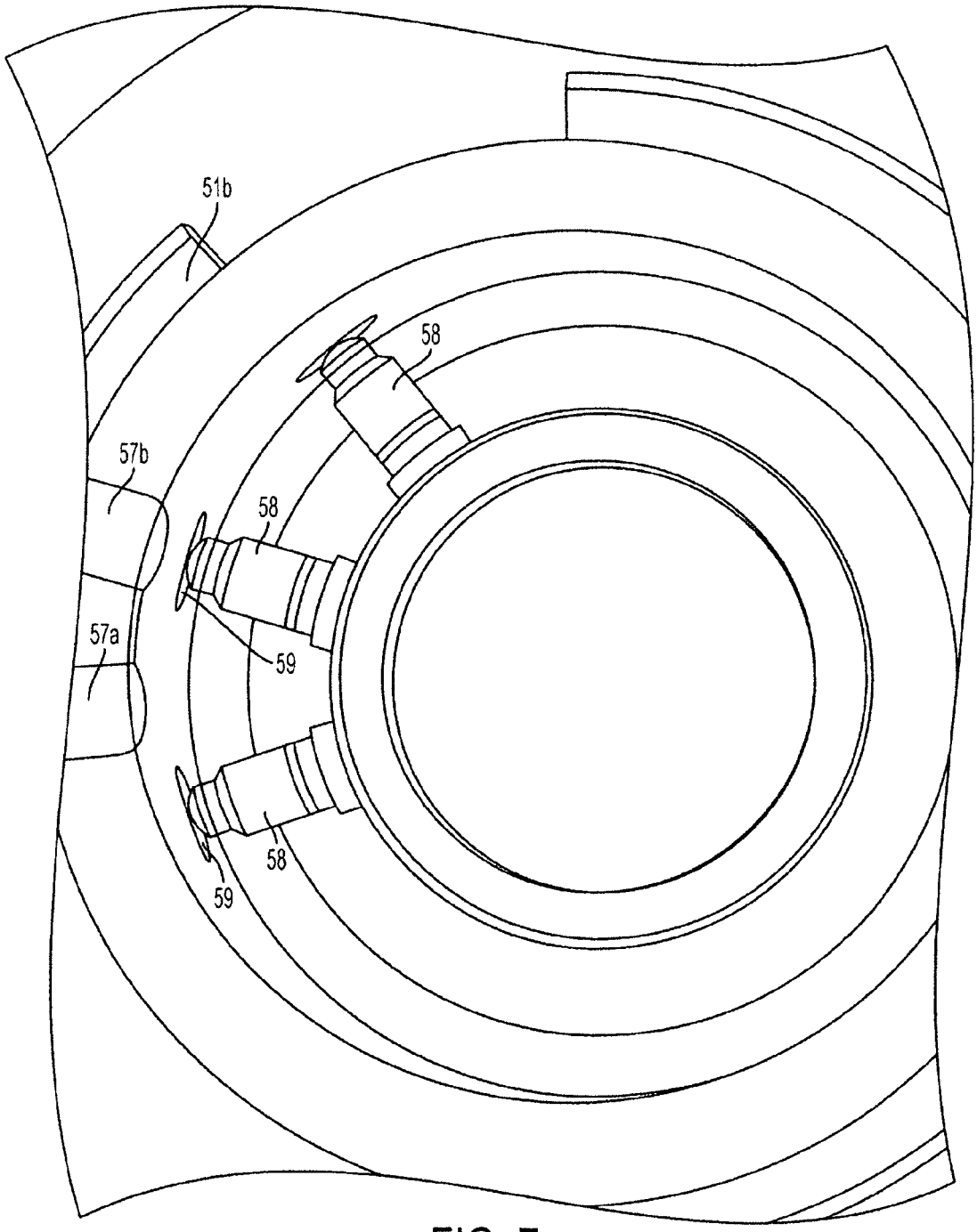
FIG. 7 shows an enlarged rear inside view of the rear end of the main housing of FIG. 2.

In the second groove 57*b*, the switch 62 is enabled through the alignment of spring-loaded contact pins 58 located on the tail cap 50 with stationary contact plates 59, located within the flexible printed circuit board 33. The alignment of the spring-loaded contact pins 58 with contact plates 59 is illustrated in FIG. 7. In contrast, whenever the spring-loaded contact pins 58 are not in alignment with contact plates 59, the switch is not enabled. In certain embodiments, the first grooved position 57*a* can be the enabled position, and the second grooved position 57*b* can be the disabled position. It should be noted that the number of contact pins and corresponding contact plates can vary in number and are not limited to those shown in the figures. Also, the contact plates 59 may be located directly on the housing 20 or on a printed circuit board 33 within the housing 20.

Figure 13:
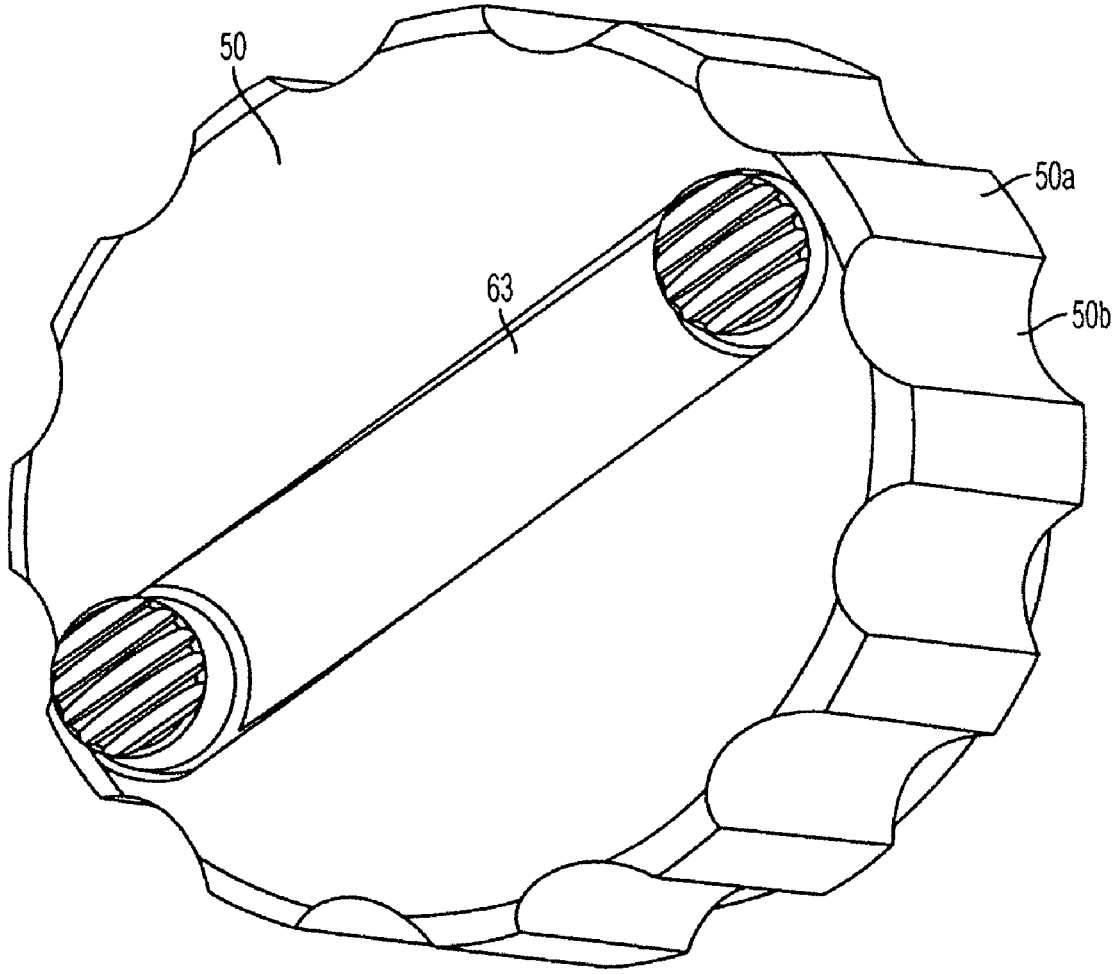
FIG. 13 is a rear perspective view of the tail cap, featuring an ambidextrous switch bar.
Figure 14:
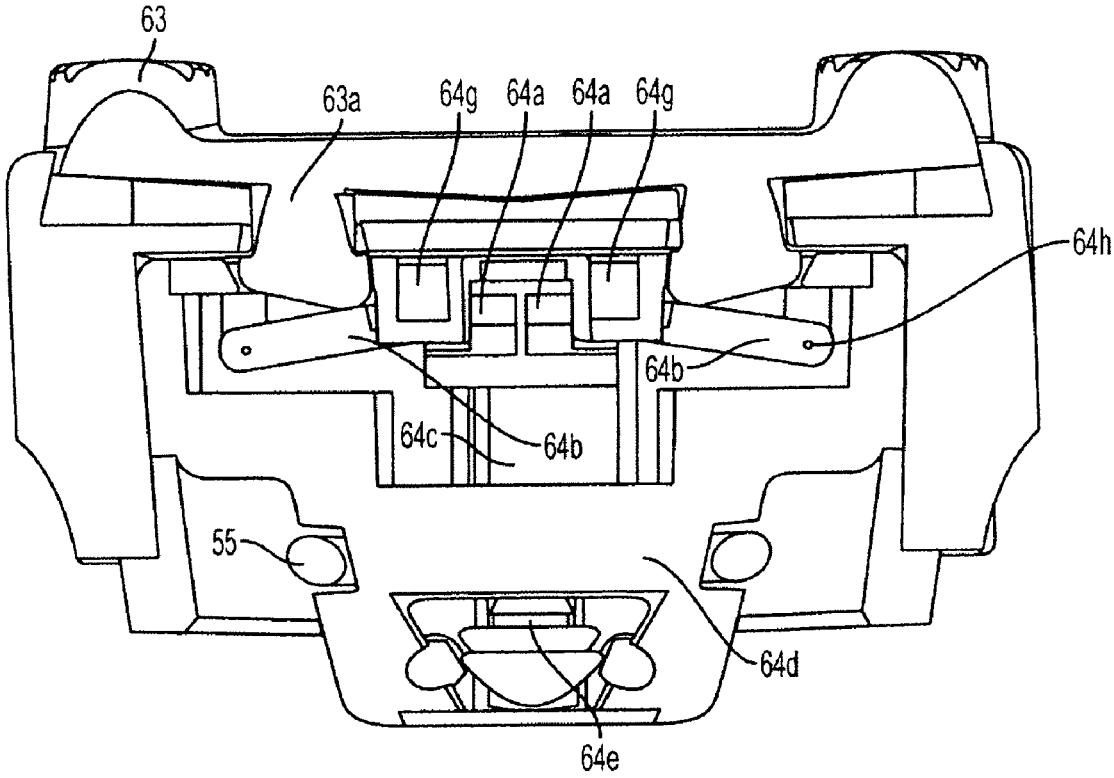
FIG. 14 is a sectional view of the tail plug, showing the components of the magnetic switch with the switch bar in the "released" position.

In still other embodiments, the rear surface of tail cap 50 features an ambidextrous switch 62 which is illustrated in FIGS. 13-14. In certain embodiments, ambidextrous switch includes two separate spring-loaded push button switches 62*a*, 62*b*, mounted on opposite sides of the tail cap 50 and acting in parallel, which allows either switch to be used interchangeably to turn the flashlight 10 on or off or to activate one of several lighting modes. In other embodiments, a switch bar 63 mounted transversally on the outside face of the rear wall of the tail cap 50 or single push button is mechanically linked by a lever or levers 64*b* to a magnet or magnets 64*a* that form part of a magnetic switch 64 contained in cavities 64*c* and 64*f* of the tail plug 54. The ambidextrous switch 62 is optionally linked to a pre-programmed electronic circuit, for multi-mode activation. The lighting modes may include one or several of the following: low intensity, high intensity or a multitude of intermediate intensities, continuous, intermittent, flashing, pulsating and strobe modes.

In yet another embodiment, the tail cap 50 comprises a single switch centrally or non-centrally located on the rear surface of tail cap 50. The number of switches positioned on the rear surface of tail cap 50 can therefore be limited to a single switch or a plurality of switches used interchangeably to turn the flashlight 10 on or off or to activate one of several lighting modes.

One important feature of the present subject matter lies in the fact that the bayonet mount locking mechanism of the tail cap 50 allows for extremely quick battery exchange, and ensures that the switch 62 and contact pins 58 return to the intended position, after the tail cap 50 is reinserted.

Moreover, the locking mechanism of the tail cap 50 also serves a dual purpose. The locking mechanism not only secures the tail cap 50 on the flashlight 10, but it also enables or disables the switch 62 that activates, or deactivates the flashlight 10 and/or its various lighting modes. The disabled position prevents the flashlight 10 from being inadvertently turned on, which results inter alia in (a) saving of battery power, and (b) prevention of accidental disclosure of the position of the user, when, for example, the light is used as a tactical flashlight, for military or law enforcement purposes.

The use of an ambidextrous switch mounted on the tail cap allows the flashlight to be turned on or off with either hand, and from either side of the flashlight, even if the flashlight is mounted on a separate device such as a handgun. In the latter situation, the short length of the barrel provides very little space for mounting the flashlight underneath the barrel of the handgun. Further, the presence of the trigger guard typically prevents the use of a single push-button switch centrally located, on the rear face of the flashlight, as there is not sufficient space between the trigger guard and the rear face of the flashlight to activate the switch with a finger. The fact that the ambidextrous switch 62 can be activated from either side, and the fact that it is located outside of or extends laterally beyond the projection of the trigger guard, obviate the interference of the trigger guard. Further, by keeping the switch location on the rear surface of the tail cap 50, the risk of the switch being accidentally activated by hand contact or by contact with a foreign object, is minimized.

In the first grooved position 57*a*, the flashlight switch 62 is disabled, in the off position because spring-loaded contact pins 58 are not aligned with contact plates 59. FIG. 16 is another perspective view of the previously described lockout position where only the detent mechanism 56 and the spring-loaded contact pins 58 of the tail cap 50 are visible.

Figure 8:
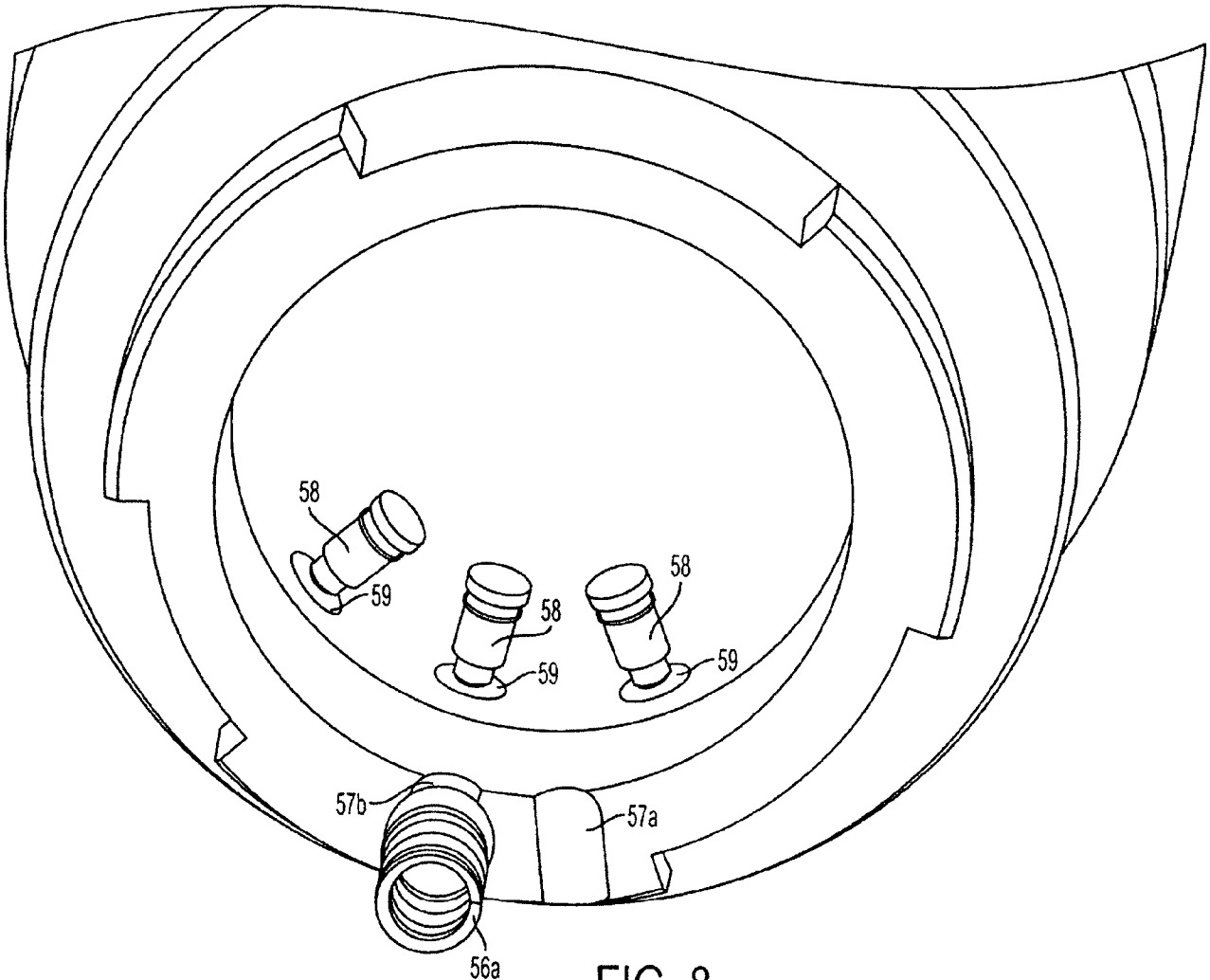
FIG. 8 is a rear perspective view of the main housing of FIG. 2 illustrating the position of the detent mechanism and contact pins in an operational mode of the flashlight.
Figure 9:
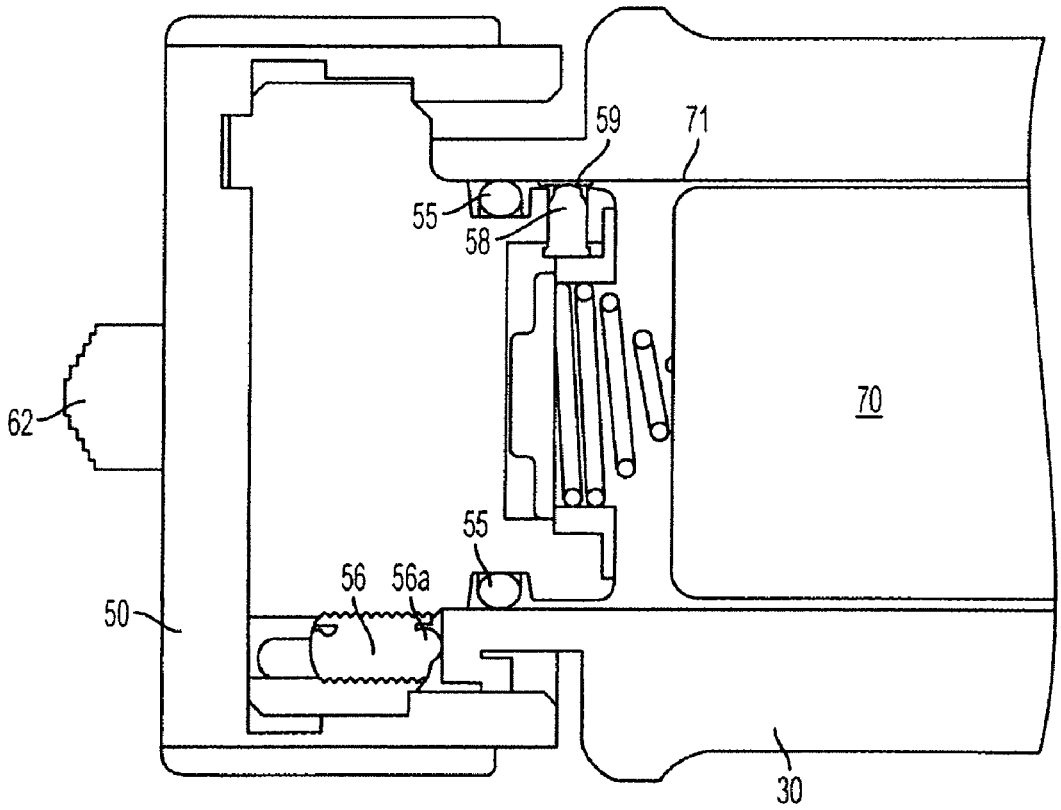
FIG. 9 is a partial cross-sectional view of the rear end of the flashlight.

Continued clockwise rotation of the tail cap 50, as shown in FIG. 14, results in the flat spring or spring-loaded ball bearing 56*a* to be positioned within the second groove 57*b* and the spring-loaded contact pins 58 to be aligned with contact plates 59, thereby enabling the switch and making the flashlight operational. FIG. 8 is another perspective view of this operational position, where only the detent mechanism 56 and the spring-loaded contact pins 58 of the tail cap 50 are visible. FIG. 9 is a partial cross-sectional view of the rear of flashlight 10. Spring element 71 is in contact with battery 70, the spring-loaded contact pins 58 are aligned with contact plates 59 and spring or spring-loaded ball bearing 56*a* is positioned within the second groove 57*b*.

Figure 10:
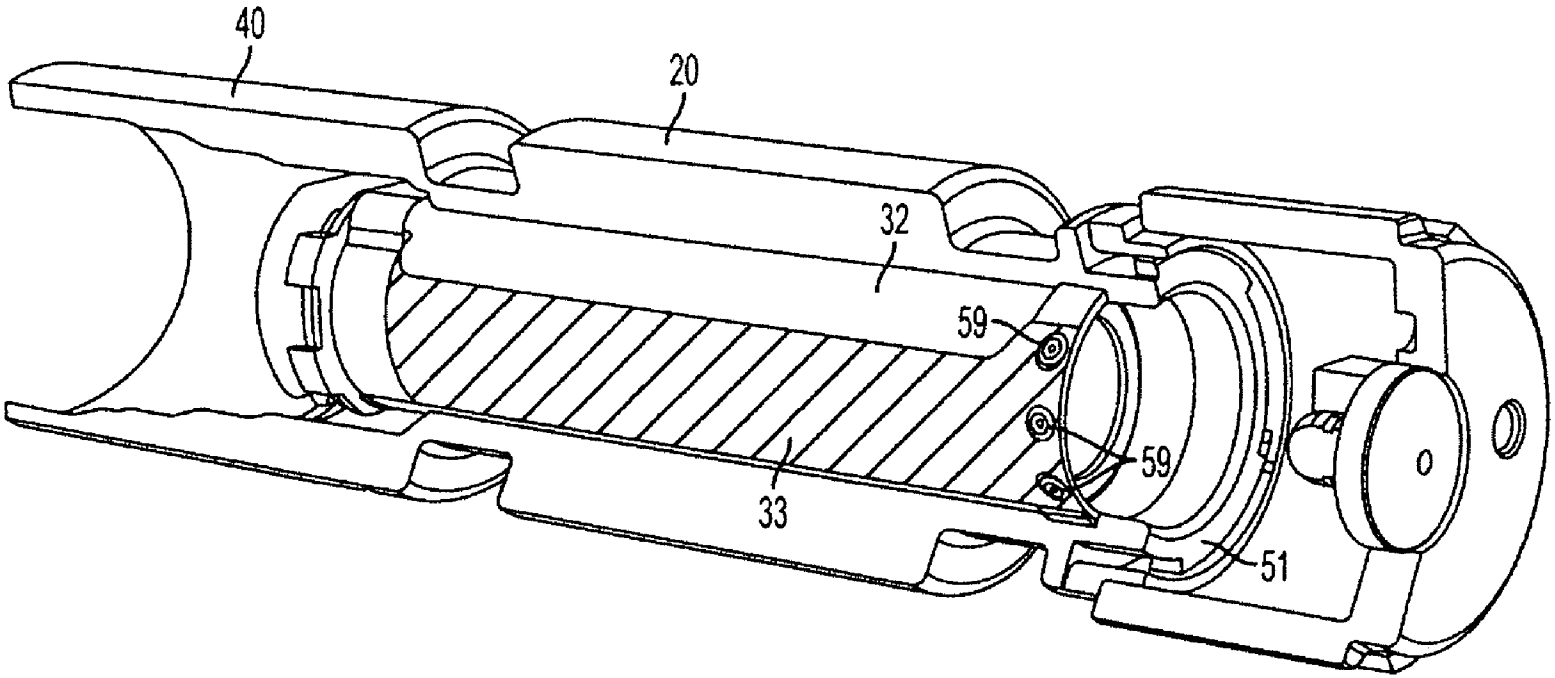
FIG. 10 is a cross-sectional view of the main housing of the flashlight, parallel to its main axis. It illustrates the interrelation between the main housing, the battery sleeve, and the flexible printed circuit board.

FIG. 10 is a cross-sectional view of the flashlight illustrating the battery sleeve 32, flexible PCB 33, and contact plates 59 located on the flexible PCB 33.

Figure 11:
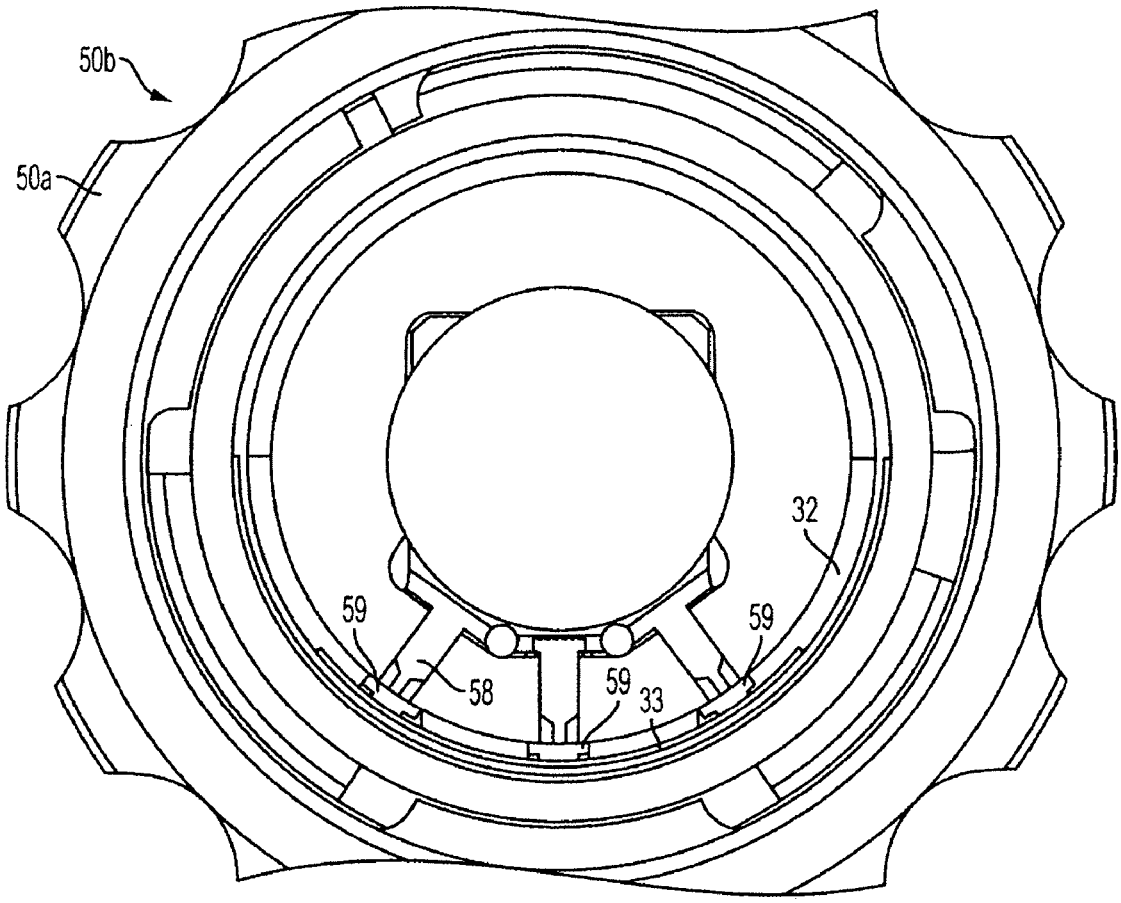
FIG. 11. is a cross-sectional view of the interface of the main housing and the tail cap of the flashlight, perpendicular to its main axis.

FIG. 11 is a rear sectional view of the tail cap 50 main housing 20 interface showing the interrelation of the spring-loaded contact pins 58, contact plates 59, sleeve 32 and flexible PCB 33.

Figure 12:
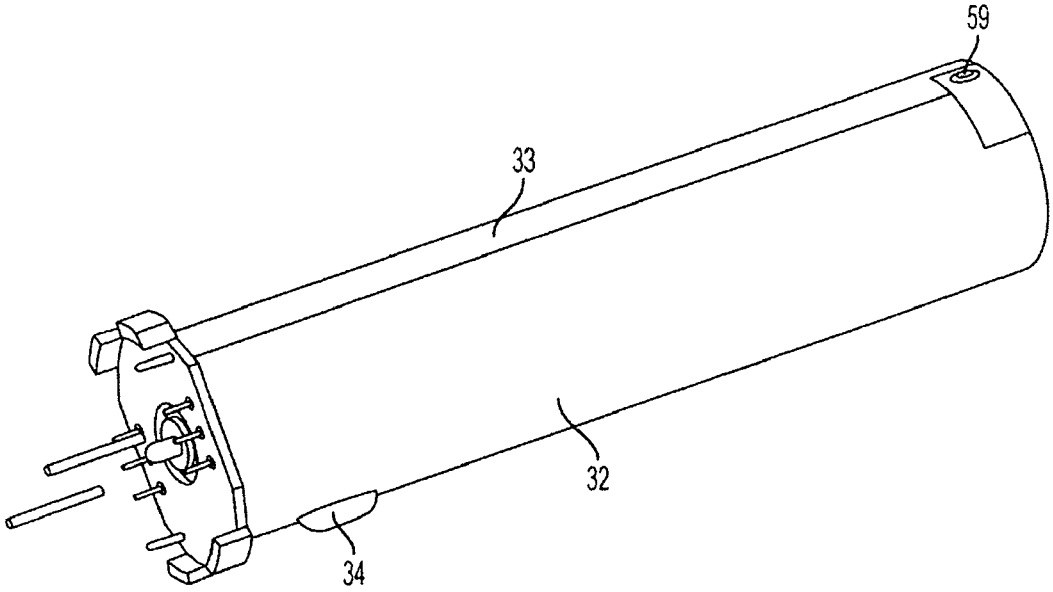
FIG. 12 is a perspective view of the sleeve-printed circuit board assembly.

FIG. 12 is a perspective view of the sleeve 32 and printed circuit board 33 illustrating the tab 34 that is used to prevent rotation of the sleeve 2/PCB 33 assembly, when inserted in the housing 20.

FIG. 13 is a rear perspective view of the tail cap 50 showing the switch bar 63, allowing ambidextrous use.

Figure 15:
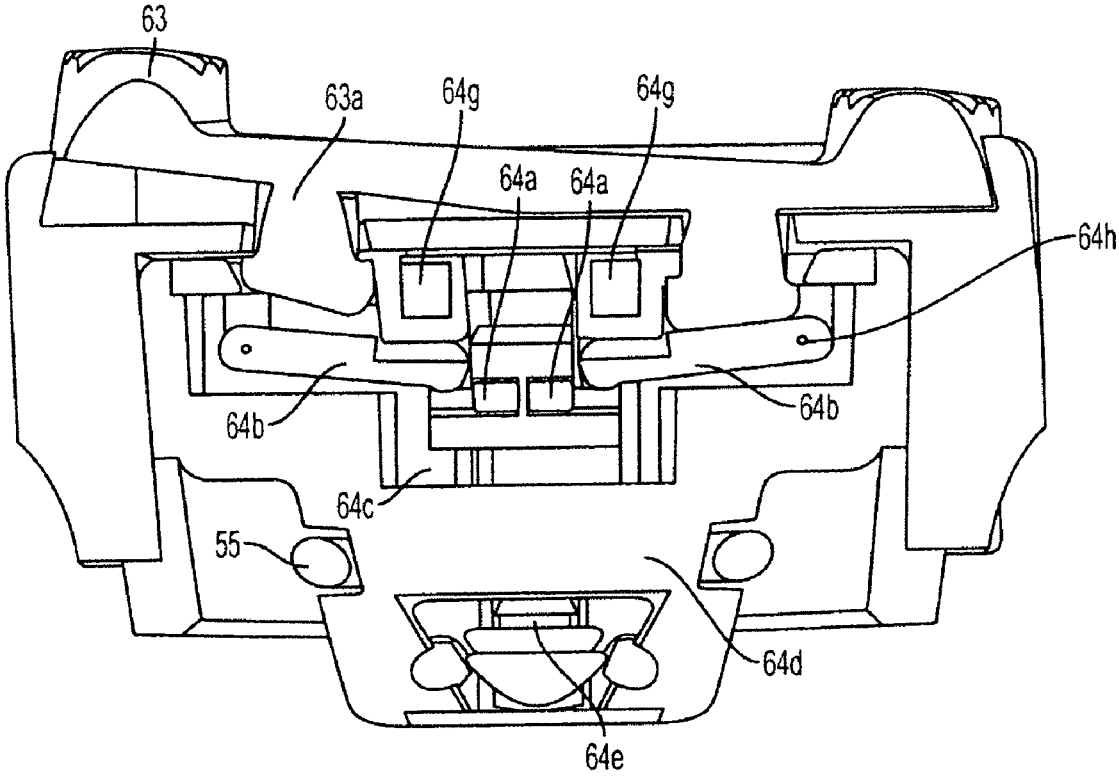
FIG. 15 is a sectional view of the tail plug, showing the components of the magnetic switch with the switch bar in the "depressed" position.

FIGS. 14 and 15 represent cross-sectional views of the tail cap 50 and tail plug 54 contained therein. FIG. 14 shows the position of the levers 64*b* and first set of magnets 64*a* when the switch bar 63 is depressed, whereas FIG. 15 shows their respective positions when the pressure from the operator on the switch bar is released.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

In the previous description, numerous specific details are set forth, such as specific materials, structures, processes, etc., in order to provide a better understanding of the present subject matter. However, the present subject matter can be practiced without resorting to the details specifically set forth herein. In other instances, well-known processing techniques and structures have not been described in order not to unnecessarily obscure the present subject matter.

Only the preferred embodiments of the present subject matter and but a few examples of its versatility are shown and described in the present disclosure. It is to be understood that the present subject matter is capable of use in various other combinations and environments and is susceptible of changes and/or modifications within the scope of the inventive concept as expressed herein.

What is claimed is:

1. An electrically powered device adapted to be connected to an electrical power source, comprising:

a housing adapted to receive an electrical power source;

a cap being adapted to be removably mountable unto said housing by means of a bayonet mount mechanism, whereby the bayonet mount mechanism comprises a plurality of male portions and female portions, the male portions and female portions being respectively adapted to mate with and to rotationally engage with one another, the male and female portions of said bayonet mount mechanism being provided on said cap and said housing, and wherein after sufficient rotational engagement of the male portions of the bayonet mount with the female portions thereof the cap is securely retained unto the housing, the cap is selectively movable, relative to the housing, between a position in which the electrically powered device is non-operable, and a position in which the electrically powered. device is operable, whilst at all times remaining securely retained unto the housing.

2. The electrically powered device of claim 1, wherein said electrically powered device is a lighting device adapted to receive a light source.

3. The electrically powered device of claim 1, wherein the electrical power source is an electrical energy storage device such as at least one battery and the housing of the device is adapted to receive said electrical energy storage device.

4. The electrically powered device of claim 1, wherein:

the male portions of the bayonet mount mechanism form a substantially cylindrical member, featuring a plurality of lugs provided on an outer sidewall of said substantially cylindrical member; and the female portions of the bayonet mount mechanism form a substantially circular ring featuring a plurality of slots, corresponding to a number of lugs on the male member, which substantially circular ring is adapted to mate with and to rotationally engage with said lugs provided on the male portion.

5. The electrically powered device of claim 4, wherein the lugs have a front face facing towards the female portion of the bayonet mount mechanism, and a back face, facing away from said female portion, and at least a portion of said back face of the said lugs forms a bevel.

6. The electrically powered device of claim 1, wherein the housing features an inner compartment adapted to receive a circuit board and said inner compartment and said circuit board are respectively provided with complementary registration means to properly position said circuit board within said inner compartment.

7. A cap removably mountable to a housing of an electrically powered device, said cap comprising:

one portion of a bayonet mount mechanism, wherein the bayonet mount mechanism has a male portion and a female portion respectively adapted to mate with and to rotationally engage with one another;

at least one electrical switch; and wherein after sufficient rotational engagement of the male portion of the bayonet mount with the female portion thereof the cap is securely retained unto the housing, and the cap is selectively movable, relative to the housing, between a position in which the electrically powered device is non-operable, and a position in which the electrically powered device is operable, whilst at all times remaining securely retained unto the housing.

8. The cap of claim 7, wherein said cap is provided with an inner cavity that is adapted to receive a plug.

9. The cap of claim 8, further comprising a spring element, made out of an electrically conductive material, positioned within a cavity of the plug and extending beyond an outer front face of the plug along a main axis of the electrically powered device towards a housing of said electrically powered device.

10. The cap of claim 9 further comprising a plurality of retractable electrical contact plugs positioned along an outer diameter of the plug.

11. The cap of claim 7, wherein the electrical switch features an ambidextrous switch actuator.

12. A mechanism for rendering an electrically powered device operable or non-operable, wherein said electrically powered device comprises a cap removably mountable to a housing adapted to receive said cap by means of a bayonet mount mechanism, and wherein the cap is provided with electrical contact plugs, and the housing is provided with electrical contact plates, the cap being selectively movable relative to the housing when mounted thereto, between an operable position in which said electrical contact plugs come into contact with said electrical contact plates, and a non-operable position in which the electrical contact plugs are not in contact with said electrical contact plates.

13. A lighting device comprising:

a housing adapted to receive at least one battery and a light;

a cap removably mountable unto said housing;

a bayonet mount mechanism for mounting said cap unto said housing, the bayonet mount mechanism comprising a male portion and a female portion, the male portion and female portion being respectively adapted to mate with and to rotationally engage with one another, wherein one of the male and female portions of said bayonet mount mechanism is provided on said cap and the other one is provided on said housing; and a mechanism for powering the light, the mechanism being operational when the cap is mounted on the housing by means of the bayonet mount mechanism, the mechanism being actuated by rotating the cap between a position in which the electrically powered device is nonoperable, and a position in which the electrically powered device is operable, whilst at all times remaining securely retained unto the housing.

14. The lighting device of claim 13, wherein the cap further comprises a switch for turning on or off the light.

15. The lighting device of claim 14, wherein the switch is further adapted for selecting a lighting mode.

16. The lighting device of claim 13, further comprising a gasket for sealing the cap to the housing when the cap is mounted on the housing by means of the bayonet mount mechanism.

17. The lighting device of claim 13, wherein the cap has an exterior periphery forming a gripping surface.

* * * * *